US005934572A

United States Patent [19]

Hofmann et al.

[11] Patent Number: 5,934,572

[45] Date of Patent: Aug. 10, 1999

[54] CONTROL SPRING FOR A FUEL INJECTION VALVE FOR INTERNAL COMBUSTION ENGINES

[75] Inventors: Karl Hofmann, Remseck, Germany; Peter Kuegel, Bursa; Ibrahim Oezyesilova, Hatay-Izmir, both of Turkey

[73] Assignee: Robert Bosch GmbH, Stuttgart, Germany

[21] Appl. No.: 08/894,503

[22] PCT Filed: Aug. 8, 1996

[86] PCT No.: PCT/DE96/01480

§ 371 Date: Oct. 10, 1997

§ 102(e) Date: Oct. 10, 1997

[87] PCT Pub. No.: WO97/22801

PCT Pub. Date: Jun. 26, 1997

[30] Foreign Application Priority Data

Dec. 16, 1995 [DE] Germany ..... 195 47 102

[51] Int. Cl.[6] ..... F02M 61/20

[52] U.S. Cl. ..... 239/533.9; 267/180

[58] Field of Search ..... 239/533.1, 533.2, 239/533.8, 533.9; 267/180

[56] References Cited

U.S. PATENT DOCUMENTS

| | | | |
|---|---|---|---|
| 2,521,670 | 9/1950 | Starkey et al. | 267/180 |
| 2,586,646 | 2/1952 | Graham | 267/180 |
| 2,622,448 | 12/1952 | Lorig | 267/180 |
| 3,511,280 | 5/1970 | Mercier | 267/180 |
| 3,727,902 | 4/1973 | Burckhardt et al. | 267/180 |
| 5,165,607 | 11/1992 | Stevens | 239/533.4 |

*Primary Examiner*—Andres Kashnikow
*Assistant Examiner*—Lisa A. Douglas
*Attorney, Agent, or Firm*—Edwin E. Greigg; Ronald E. Greigg

[57] ABSTRACT

A fuel injection valve for internal combustion engines having, a valve member, which is axially displaceable in a valve body and which on one end has a valve sealing face with which it cooperates with a stationary valve seat in order to control an injection cross section, and having at least one valve spring, which urges the valve member in the direction of the valve seat and is braced on its other end on a stationary stop. To increase the spring force of the valve spring while the outer diameter remains the same, the windings of the valve spring, embodied as a helical spring, have a circular basic cross section (Y), which in a region pointing radially outward from the axis (X) of the valve spring has a ground face oriented parallel to the spring axis (X).

2 Claims, 1 Drawing Sheet

CONTROL SPRING FOR A FUEL INJECTION VALVE FOR INTERNAL COMBUSTION ENGINES

PRIOR ART

The invention is based on a fuel injection valve for fuel injection engines. In one such fuel injection valve, known from German Patent 29 43 744, a valve member is guided axially displaceably in a valve body. On one end, toward the combustion chamber, the valve member has a valve sealing face, with which it cooperates with a stationary valve seat on the valve body for the sake of controlling an injection cross section. On its other end, remote from the combustion chamber, the valve member is acted upon by a valve spring, which presses the valve member into contact with the valve seat. This valve spring is inserted into a spring chamber inside the housing of the injection valve, in this case in a retaining body, and is braced with its end remote from the valve member on a stationary stop face. The valve spring is embodied as a helical spring, whose windings of spring wire have a circular cross section.

The spring force of the valve spring determines the opening pressure at the injection valve, which is built up from the high fuel pressure engaging the valve member in the opening direction. The capacity or spring force of the valve spring thus has major significance; this spring force is dependent essentially on the cross-sectional area of the wire at the windings. If the spring force is to be increased, it is usual with conventional round wire to increase the wire thickness, so that its maximum cross-sectional area is the result of the predetermined outside and inside diameter of the winding cross section.

The known fuel injection valve has the disadvantage, however, that increasing the wire thickness or axially lengthening the valve spring in order to increase the spring force meets with structural limits, since the existing installation space for the spring chamber is limited and cannot be increased without making extensive changes in the injection valve, so that increasing the spring force of the valve spring is not possible without making complicated changes in the injection valve.

ADVANTAGES OF THE INVENTION

The fuel injection valve according to the invention for internal combustion engines, has the advantage over the prior art that the spring force of the valve spring can be increased without increasing the required installation space for the valve spring in the housing of the injection valve; this advantage is especially pronounced in springs with a very small inside diameter and hence a low winding ratio (Dm/y up to 2.5).

This becomes advantageously possible in that the valve spring, embodied as a helical spring, is made of thicker spring wire with an increased basic cross section at the windings and is then ground down on the outside diameter far enough that the valve spring can just be inserted into the cylindrical spring chamber, in which it then has only as much play relative to the inner wall as is needed when the valve spring is compressed. The initially circular basic cross section of the spring windings then has ground faces on its ends pointing radially outward with respect to the spring axis, and these ground faces are oriented parallel to the spring axis and to the wall of the spring chamber.

In this way, while the installation space for the valve spring remains the same, greater opening pressures can be attained, and in the case where two valve springs that come into play successively are used, in so-called two-spring holders, greater opening pressure differences can be achieved.

In addition, the tolerance in terms of the outer diameter of the valve spring can be reduced to a minimum amount, compared with unmachined springs.

The valve spring embodied according to the invention has the advantage over alternative wire cross sections, such as rectangular, elliptical or other shaped wires, that the wire production involves no additional expense, and the valve spring can thus be produced more easily and economically than the aforementioned versions. Moreover, by the subsequent grinding down of the outer diameter of the valve spring, more accurate outer diameters of the spring and thus better utilization of the space in the predetermined spring chamber can be achieved. Furthermore, in this way possible flaws in the material on the outer diameter of the valve spring are simultaneously eliminated.

The use of this optimized spring is not limited to the described use in a fuel injection valve but can instead be applied anywhere that despite a restricted installation space the spring force of a restoring spring is to be increased, such as in injection pumps or gas exchange valves of internal combustion engines and the like.

Further advantages and advantageous features of the subject of the invention can be learned from the specification, drawing and claims.

BRIEF DESCRIPTION OF THE DRAWINGS

One exemplary embodiment of the fuel injection valve of the invention for internal combustion engines is shown in the drawing and described in further detail in the ensuing description.

DESCRIPTION

Figure 1:
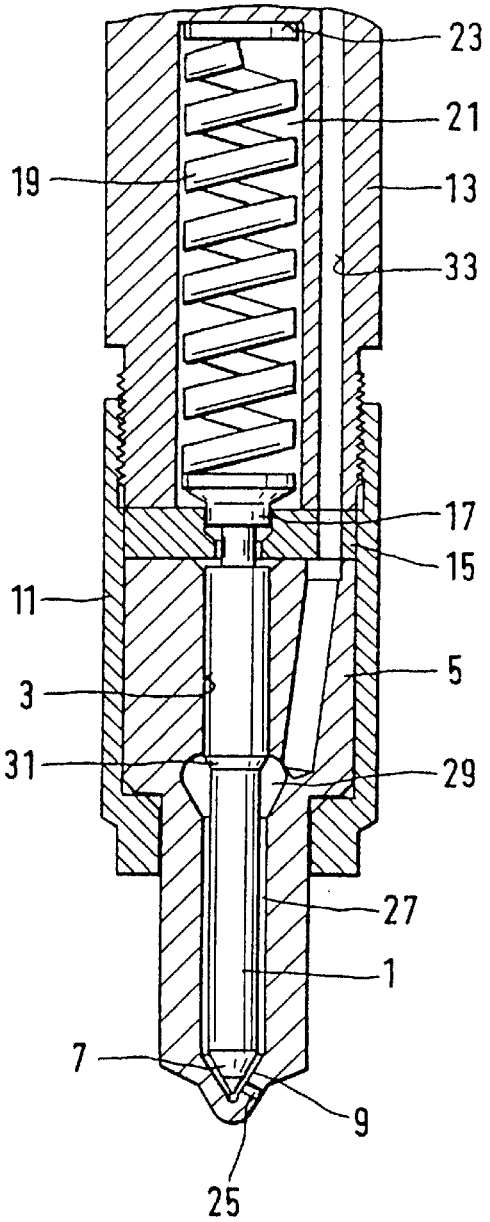
FIG. 1 shows a longitudinal section through the fuel. injection valve.

In the exemplary embodiment shown in FIG. 1 of the fuel injection valve according to the invention for internal combustion engines, a pistonlike valve member 1 is guided axially displaceably in a bore 3 of a valve body 5, which on its one end, toward the engine combustion chamber, has a conical valve sealing face 7, with which it cooperates with a conical valve seat 9 on the inward-projecting, closed end of the bore 3. The valve body 5 is braced axially by its end remote from the combustion chamber, by means of a tension nut 11, against a valve holding body 13, and a shim 15 with a central opening is fastened between the end faces of the valve body 5 and the valve holding body 13.

On its end remote from the valve seat 9, the valve member 1 is urged via a pressure pad 17, protruding through the shim 15, in the direction of the valve seat 9 by a valve spring 19 embodied as a helical spring, which is inserted into a cylindrical spring chamber 21 in the valve holding body 13 and is braced on its other end on a stationary stop 23 formed by the upper axial wall of the spring chamber 21.

Downstream of the sealing seat between the valve sealing face 7 and the valve seat 9, an injection opening 25 is also provided in the wall of the valve body 5; beginning at the bore 3, this opening discharges into the combustion chamber of the engine to be supplied.

The high-pressure delivery of fuel to the sealing seat is effected in a known manner via an annular conduit 27, formed between the shaft of the valve member 1 and the wall of the bore 3; the annular conduit widens in the region of an annular shoulder 31 of the valve member 1 to form a pressure chamber 29, into which a pressure line 33, leading away from an injection pump, not shown, discharges.

Figure 2:
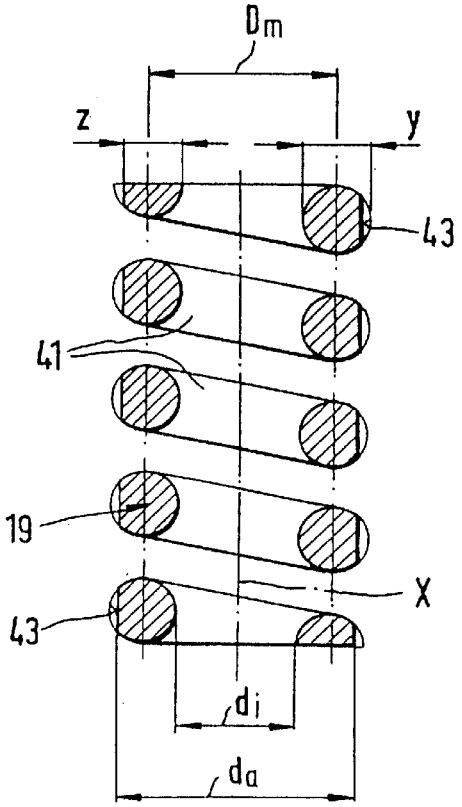
FIG. 2 shows an enlarged detail of the valve spring of FIG. 1.

To increase the spring force while the outer dimensions remain the same, the valve spring 19, as shown on a larger scale in FIG. 2, has ground face 43, which are oriented parallel to the spring axis X and to the inner wall of the cylindrical spring chamber 21, on the ends pointing radially outward from the spring axis X of the circular-annular basic cross section y of its spring windings 41 which are wound in a spiral.

The valve spring 19 is first made from a round spring wire with such a large cross section y that the theoretical outside diameter of the unmachined valve spring 19 is larger than the inside diameter of the spring chamber 21. In a subsequent operation, so much material is removed, preferably being ground off, from the outer diameter of the valve spring that the valve spring 19 is just barely insertable, with the requisite play, into the spring chamber 21.

The remaining cross-sectional area z of the spring windings 41 is still significantly greater, despite the ground faces 43, than the cross-sectional area of an unmachined valve spring with annular spring wire with the identical outside diameter, so that the attained spring force of the valve spring 19 can be increased considerably without requiring additional installation space.

The ratio y/z is preferably in a range from 1.05/1 to 1.3/1.

It would be obvious to one skilled in the art that a prior art spring would have spirals with a cylindrical cross section from the inner diameter to the ground face 43 so that the spiral would be smaller in diameter.

The foregoing relates to preferred exemplary embodiments of the invention, it being understood that other variants and embodiments thereof are possible within the spirit and scope of the invention, the latter being defined by the appended claims.

The invention claimed and desired to be by Letters Patent of the United States is:

1. A fuel injection valve for internal combustion engines comprising a valve member (1), which is axially displaceable in a valve body (5) and which on one end has a valve sealing face (7) with which said valve member (1) cooperates with a stationary valve seat (9) in order to control an injection cross section, and a valve spring chamber (21), a valve spring (19) is embodied as a helical spring with a circular basic cross section (Y), in which said valve spring has a normal outer diameter (da) which is greater than a diameter of said valve spring chamber (21) and having a spring axis (X), each said winding of said valve spring has a ground down outer flat radial surface face in which said valve spring has a reduced diameter which is less than an inside diameter of said valve spring chamber and placed in said valve spring chamber with said surface faces oriented in a plane parallel with the spring axis (X) and in parallel with a wall of said valve spring chamber, said valve spring is braced at one end on one end of said valve member and another end is braced on a stationary stop (23), said valve spring urges the valve member 1 in a direction of the valve seat (9), and said valve spring has a slight play with respect to the inside diameter of said spring chamber (21).

2. A fuel injection valve in accordance with claim 1, in which a ratio y/z of the valve spring (19) is a range of from 1.05/1 to 1.3/1.

* * * * *